United States Patent [19]

Erickson

[11] 4,110,060

[45] Aug. 29, 1978

[54] HIGH DISPLACEMENT-TO-SIZE RATIO ORBITING FLUID MECHANISM

[76] Inventor: Frederick L. Erickson, 2610 Bosworth Dr., Fort Wayne, Ind. 46805

[21] Appl. No.: 695,722

[22] Filed: Jun. 14, 1976

[51] Int. Cl.[2] ..... F04B 19/22; F04B 29/00

[52] U.S. Cl. ..... 417/462

[58] Field of Search ..... 91/493, 496, 497; 417/534, 462–466; 123/46 R, 50 R

[56] References Cited

U.S. PATENT DOCUMENTS

| | | | |
|---|---|---|---|
| 968,126 | 8/1910 | Clark | 417/466 |
| 2,013,862 | 9/1935 | Schulz et al. | 417/463 |
| 2,130,037 | 9/1938 | Skarlund | 417/466 |
| 2,258,379 | 10/1941 | Estey | 417/463 |
| 2,539,277 | 1/1951 | Schroepfor | 417/221 |
| 3,135,094 | 6/1964 | Uress | 123/46 R |
| 3,630,178 | 12/1971 | Erickson | 125/50 R |
| 3,878,768 | 4/1975 | Aress | 417/534 |

FOREIGN PATENT DOCUMENTS

| | | | |
|---|---|---|---|
| 1,129,133 | 9/1956 | France | 417/221 |
| 1,260,047 | 3/1961 | France | 417/466 |
| 462,486 | 3/1951 | Italy | 417/273 |
| 323,810 | 9/1935 | Italy | 417/462 |
| 300,502 | 4/1929 | United Kingdom | 417/270 |

*Primary Examiner*—William L. Freeh

*Attorney, Agent, or Firm*—Gust, Irish, Jeffers & Rickert

[57] ABSTRACT

A positive displacement fluid moving mechanism having economical construction features, novel porting provisions and adjustment means which allow it to possess a very high ratio of fluid displaced per unit rotation in relation to the volume of the displacing mechanism, whereas, this feature allows increased performance due to less energy required to operate the unit due to less internal friction.

10 Claims, 11 Drawing Figures

HIGH DISPLACEMENT-TO-SIZE RATIO ORBITING FLUID MECHANISM

BACKGROUND OF THE INVENTION

The present invention relates to self starting orbiting fluid moving mechanisms and more specifically to an orbiting fluid mechanism possessing a very high fluid displacement to mechanism size, i.e. the displaced fluid per revolution is large compared to the volume of the mechanism which displaces this fluid. The object of this invention is to provide a fluid mechanism or engine which possesses a simplified mechanism yet which has certain porting advantages and a unique method of changing the displaced volume per revolution while the unit is operating.

These features are provided in order to enhance performance, reduce size, reduce friction losses and reduce cost. These features have the net effect of also reducing the energy required to operate the mechanism as a pump or to reduce the fluid energy required to operate the device as a fluid motor, internal combustion engine or fluid meter. The features herein disclosed could be used to advantage in devices built according to the disclosure of my prior U.S. Pat. No. 3,630,178.

The common prior art positive displacement fluid mechanisms possess relatively higher internal friction or resistance to flow for a given amount of fluid displaced. The present invention displaces approximately twice the amount of fluid as would be displaced by a rotary vane device of the same size, as well as resulting in decreased friction energy required to operate the device.

The rotary vane fluid mechanism has a ratio of displaced fluid to displacing mechanism of 0.35 to 0.50. The orbiting mechanism, with the configuration described herein has a ratio of displaced fluid to displacing mechanism of 0.8 and greater with about one half of the mechanism friction associated with the rotary vane device. This means the internal friction of the rotary vane fluid mechanism is about four times the orbiting fluid mechanism for the same amount of fluid displaced per shaft rotation. Typically, rotary vane fluid mechanisms exhibit high vane friction and leakage, low efficiency, and require a substantial pressure differential to operate; producing a relatively high lateral force on the rotor bearings resulting in higher wear and maintainability problems.

Another prior art fluid mechanism which has high friction and complexity is the axial and radial piston type fluid device. Self starting multi-piston (at least 3 or more pistons) mechanism are costly to fabricate, have high friction due to its many parts, require complicated valving and have a very low (0.2 to 0.3) fluid displacement-to-size ratio; although the piston type mechanisms do possess better sealing ability than the rotary vane fluid devices, they have relatively poor mechanical efficiency.

The many different types of gear mechanisms are also characterized by the problems of high friction, high leakage and low mechanical efficiency. The friction energy required to operate these units is normally higher for a given capacity than the rotary vane and piston types. In general, other prior art positive displacement, self starting fluid mechanisms require larger mechanisms with greater resistance to rotation for the same fluid displacement per shaft revolution as compared with the present invention.

SUMMARY OF THE INVENTION

The self starting positive displacement mechanism of the present invention features four interconnected moving parts which form four separate variable volume chambers (all the same maximum size). These variable volume chambers are interconnected together by novel porting means so that two of the chambers are always in communication together and are expanding in volume, and the other two chambers are always communicating together and are contracting in volume. As the mechanism rotates these chambers continuously commutate with each other so as to maintain the relationship of two chambers expanding and two chambers contracting. This basic mechanism operates similar to some of the mechanisms classified in Class 417 Subclass 463, but with certain constructional features which reduce its cost, complexity and keep friction losses to a minimum. The present invention also provides a simple and new method of changing the displaced volume per shaft rotation calibration while the unit is operating.

This invention possesses certain very desirable refinements which allow the cost of construction to be much lower in volume production than fluid mechanisms of similar operational characteristics. This feature is provided by the incorporation of two interlocking L-shaped pieces which make up the reciprocating chamber member. The pieces can be fabricated from flat stock and interlocked together to simplify sealing of the end pieces by eliminating movable spring loaded strip seals. Accordingly, it is one objective of the present invention to provide economical manufacture while maintaining a fluid device which has low friction losses.

Another feature of this invention is to provide an orbiting fluid mechanism which possesses a unique method of changing the displacement per revolution (calibration) while the unit is operating. This is achieved by sliding the drive shaft longitudinally through the eccentric and displacing the eccentric position relative to the drive shaft by means of an inclined bushing. This allows radial positioning of the eccentric as longitudinal movement of the drive shaft is accomplished.

Accordingly it is still a further object of the present invention to provide a fluid mechanism which provides a means to change the displaced volume of the mechanism while the mechanism is operating.

Still another desirable constructional feature of this invention is to reduce fluid friction at high speed by the provision of increased size ports in the side plates. Certain novel construction features are required which make the larger ports possible. It is difficult in fluid mechanisms of this design to allow large area intake and exit side plate porting in which the eccentric accomplishes the fluid valving as it rotates inside the orbiting piston. Provisions in the construction are made by cutting away part of the stationary frame end pieces in order to allow enlarging or bell-mouthing the end faces of the orbiting piston. This feature allows maximum input and exit port area in the side plates. Accordingly, it is yet another object of this invention to provide an orbiting fluid device which has increased size porting in order to operate with low fluid friction during high speed operation.

DESCRIPTION OF THE PREFERRED EMBODIMENT

The present invention relates to low friction orbiting fluid mechanisms which operate as a fluid motor, meter, pump, or internal combustion engine. This invention specifically relates to a selfstarting low friction orbiting fluid mechanism with means for changing calibration while operating and possessing a fluid displacement-to-size mechanism ratio of 0.8 and higher. This ratio being a measure of the fluid displaced through the mechanism per revolution to the actual volume of the mechanism which displaces the fluid. The described orbiting mechanism is a type similar to those in Class 417, Subclass 463, but possesses several very desirable improvements. These features include very low manufacturing cost, extremely low mechanical and fluid friction, small size, and a method for adjusting the displaced volume while operating.

Orbiting mechanism of this class have good displaced volume-to-displacing mechanism size ratios to achieve low friction; however, the present invention is a further improvement of this type mechanism which enhances very low cost, construction, provides lower mechanical friction, low fluid friction at high speed and provides a means of adjusting the displaced volume of fluid per revolution.

All present art classified in Class 417, Subclass 463 consists of a relatively reciprocating piston in which this piston has a second pumping chamber formed integral within which also contributes to the overall pumping ability of the mechanism.

Figure 1:
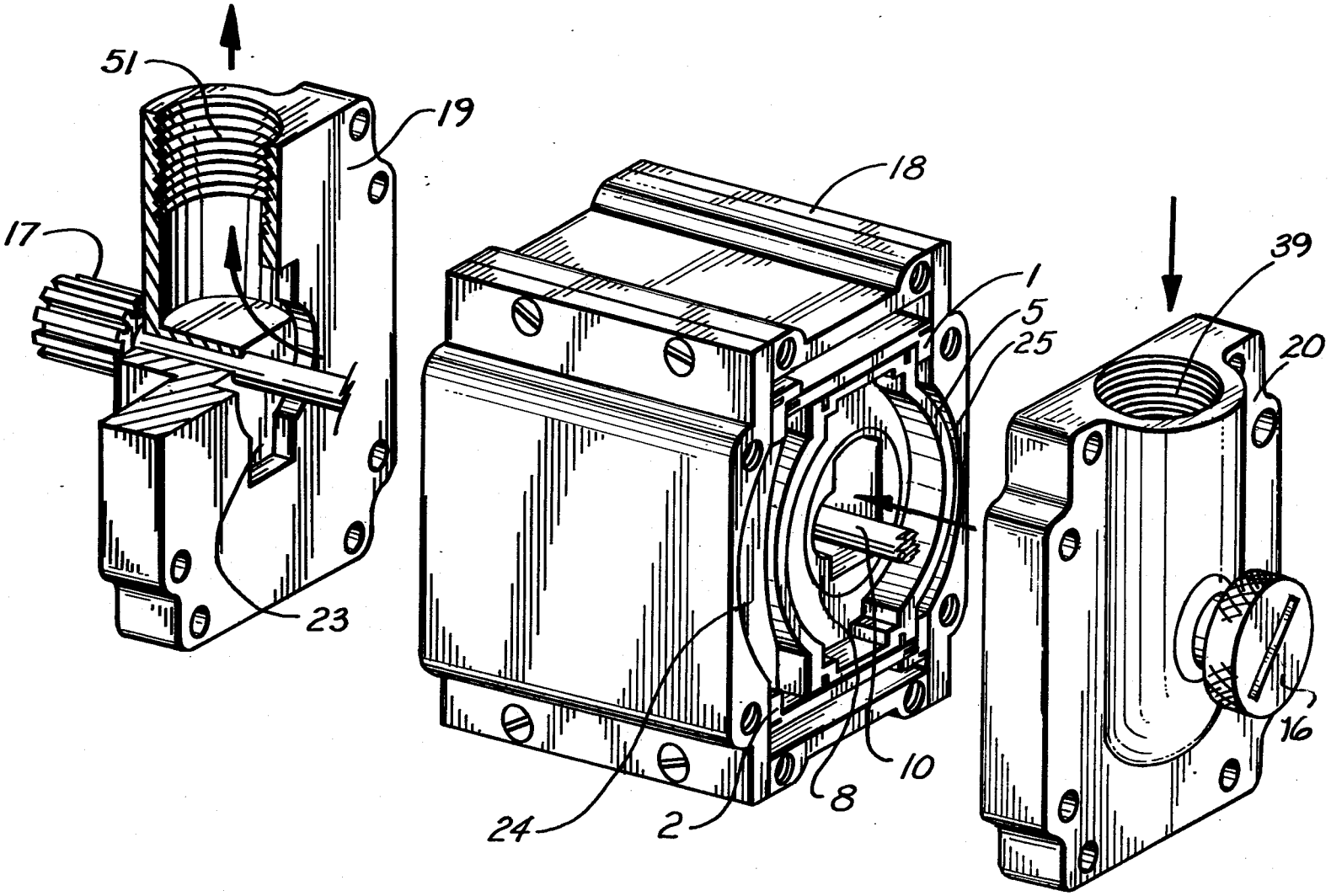
FIG. 1 is an isometric view of the invention with the end plates removed.
Figure 4B:
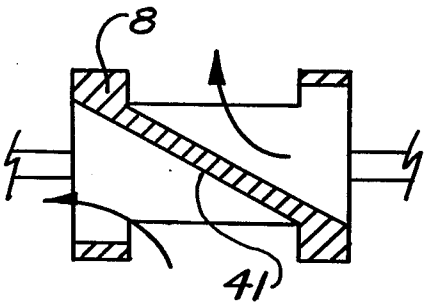
FIG. 4*b* is a simplified representation of a cross section of the mechanism of FIG. 4.
Figure 4A:
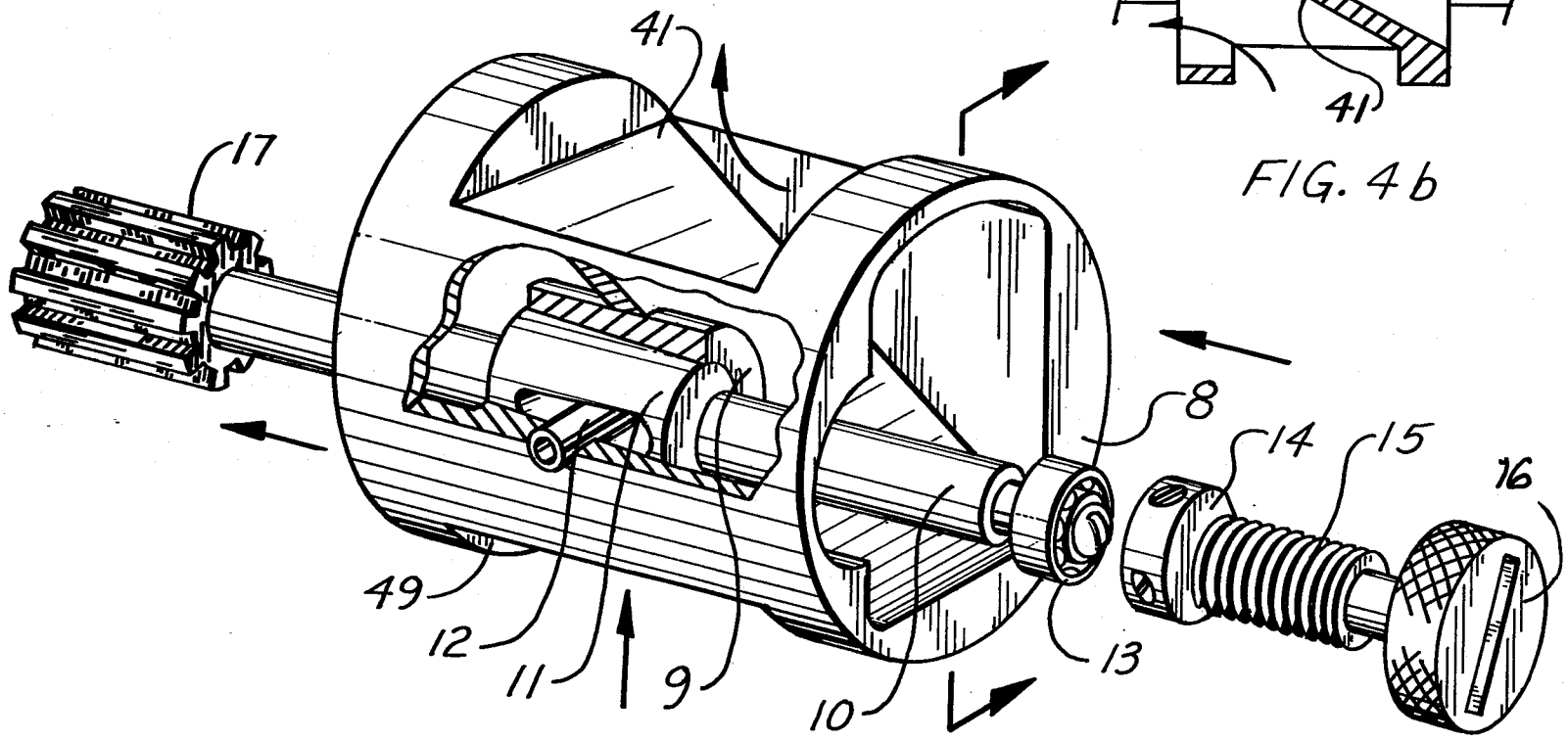
FIG. 4*a* is an isometric view of the mechanism which accomplishes fluid displacement change per adjustment.

FIG. 1 illustrates how the internal parts are related to each other. FIG. 1 illustrates the disclosed construction advantages of the present invention such as the two separate constructed L-pieces 1 and 2 which make up the reciprocating chamber member of the present invention. Also disclosed is the enlarged bell-mouthed orbiting piston 5 with its large width and associated circular cutout Nos. 24 and 25 in the stationary housing end pieces. This novel feature allows the input and output side port areas to be much larger than is possible without this feature (see a typical output port 23). Therefore, less fluid friction is encountered at high speed with the feature because of the minimal port size restriction. FIG. 4 illustrates a diagrammatic illustration of the disclosed means for adjusting the amount of fluid which is displaced by the mechanism per revolution. This is simply accomplished by adjusting the center output shaft 10 longitudinally in order to slide the angled bushing 11, inside the angled bearing 9, which in turn adjusts the eccentric valve 8 center line farther or closer to the center of the output shaft 10. This adjustment changes the stroke of the mechanism which in turn changes the fluid rate through the mechanism per unit rotation.

Figure 2:
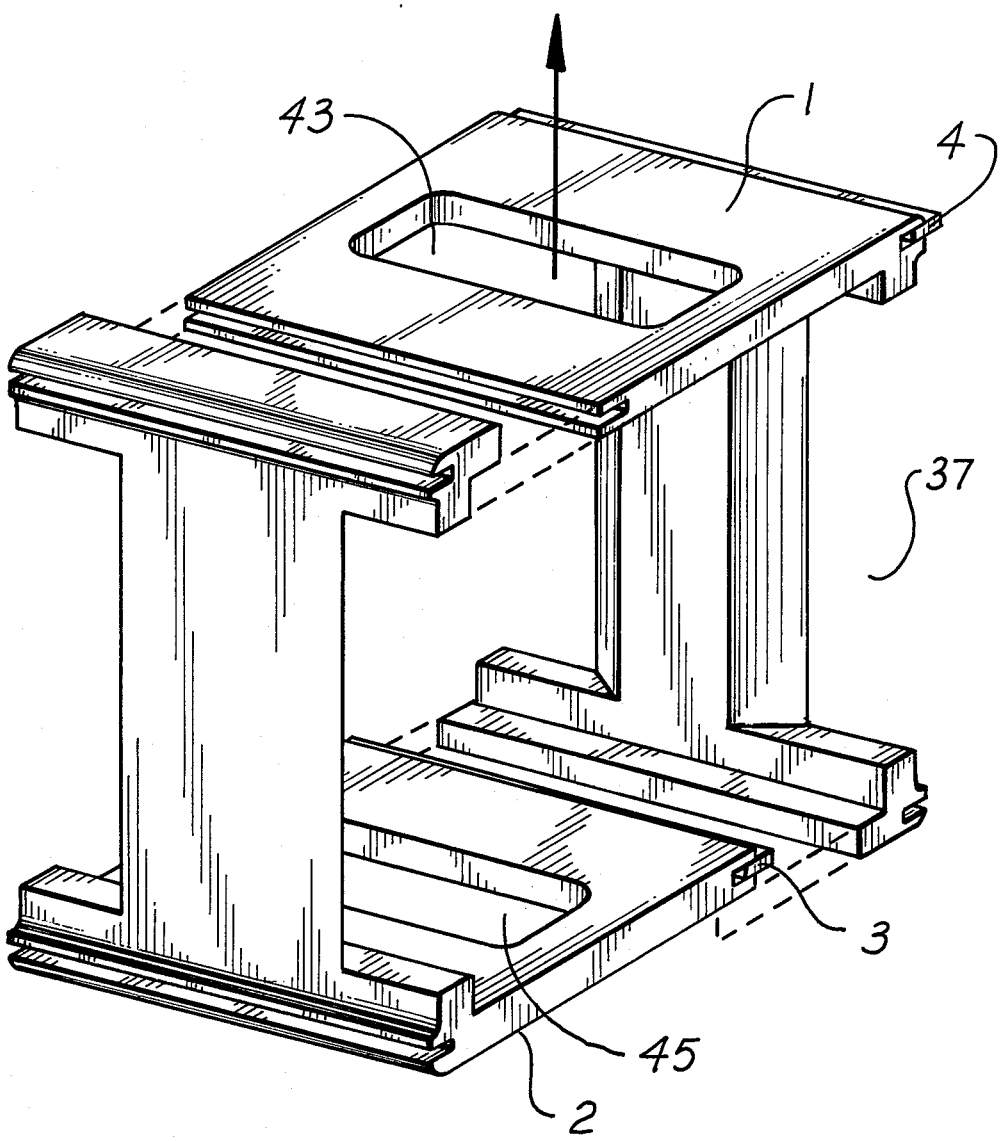
FIG. 2 is an isometric view of the two piece chamber member.
Figure 3:
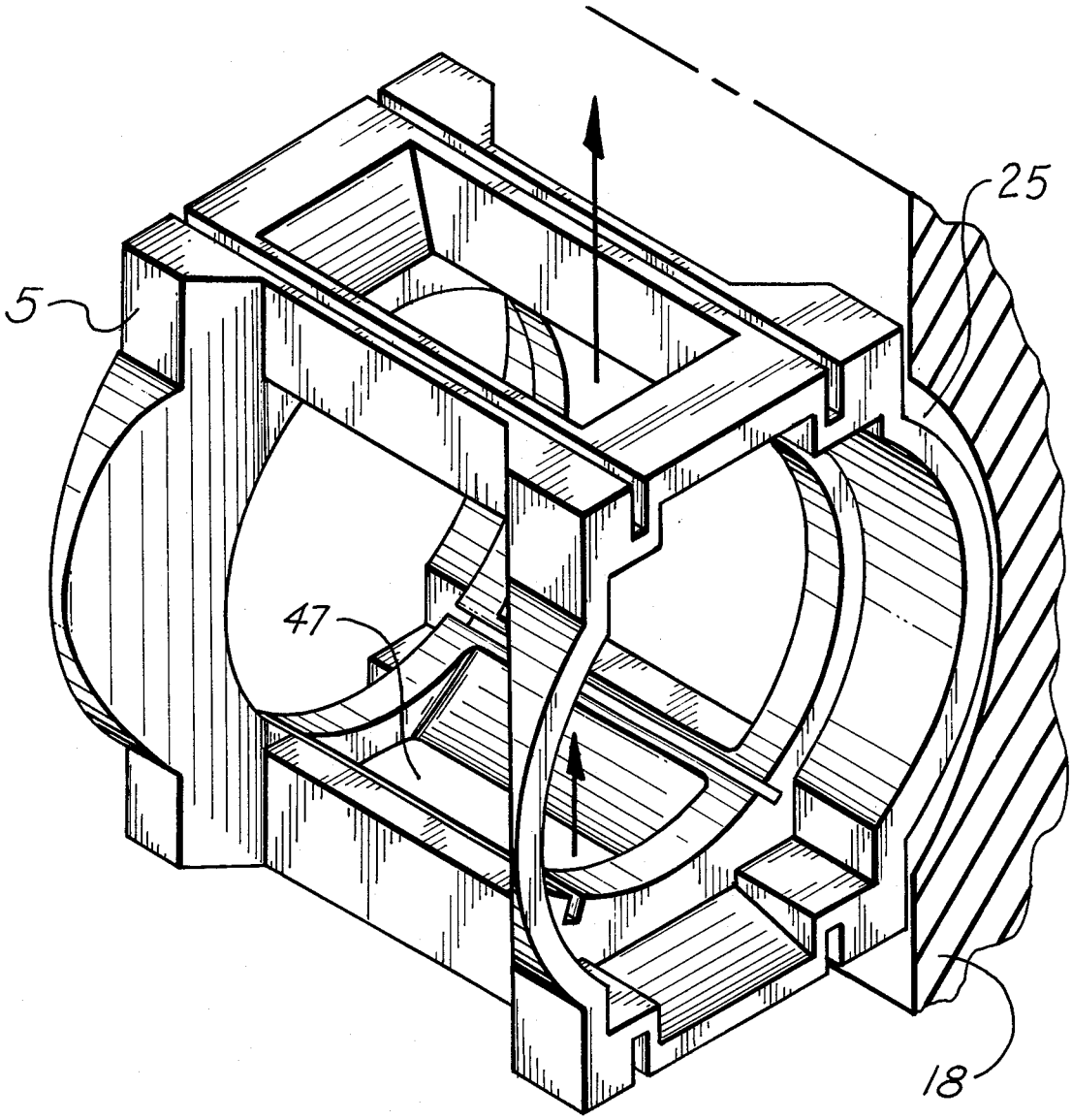
FIG. 3 is an isometric view of the bell-mouthed orbiting piston and one relieved stationary housing end piece.

As a further aid to disclosing the invention, FIG. 2 is provided to show the specific details of the two chamber member pieces. These pieces interlock together to form a strong fully sealed frame. FIG. 3 illustrates an isometric view of the disclosed bell-mouthed orbiting piston 5 with the disclosed circular cutouts (25 typical) provided in the stationary housing member 18.

These disclosed features are now discussed in detail with reference to the drawings to illustrate how the combination of these features make a significant contribution to achieving the best possible performance i.e., high displacement-to-size ratio, low friction and low construction costs for a self-starting constant flow fluid mechanism.

A two piece reciprocating chamber member FIG. 2 is disclosed which consists of two separate but identical interlocking flange pieces 1 and 2. This construction provides a means to securely connect the two pieces together to form a four sided closed box chamber member. Complete sealing of the interlocked portion of this chamber member is provided by static spring loaded seals disposed in slots, such as typical seal 3, which seals part 1 to 2 at the two diagonally opposite interlocking corners. The static seals also provide a secondary function of sealing the expandable chamber member end members against the stationary housing end pieces by forcing the dynamic strip seals (for example 4) against the housing end pieces. Notice that with this configuration the moving seals, such as 4, do no require spring loading because enough spring force is provided by the inside static seals (3 for example) to spring load the chamber member end pieces against the stationary housing 18. This technique provides sufficient sealing between the variable volume chambers. The simplified construction advantages of this two piece chamber member approach is apparent when one considers the ease of fabricating the two parts from bent up flat stock. The sealing surfaces are also all outside surfaces readily machined to a flat surface as compared with the conventional prior art closed one piece construction chamber members. Expensive internal machining methods required to obtain flat sealing surfaces with the conventional one piece chamber member are, therefore, eliminated. A further advantage of the two piece interlocked chamber member is its natural compact construction, which further reduces the mechanism size and increases the displaced fluid volume while reducing the internal friction.

It is common knowledge that all high speed or high R.P.M. fluid mechanisms require the largest possible fluid port areas in order to reduce fluid friction losses to a minimum. A unique construction means is disclosed whereby the resistance of the fluid which moves through the mechanism is significantly reduced, especially at high operational R.P.M. This feature is obtained by constructing the orbiting piston 5 and the stationary housing end members 19 and 20 in a specific manner to allow the center input/output port area such as 23 or a simlar port in end portion 20 to be of the largest possible size.

Figure 6A:
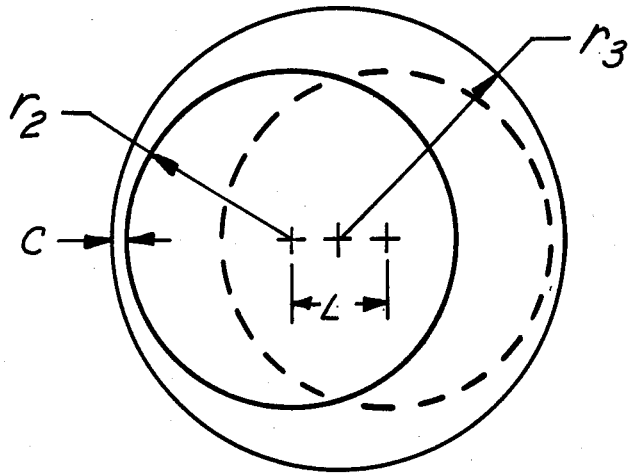
FIGS. 6*a*–6*c* are conceptual representations of certain porting and clearance limitations.
Figure 6B:
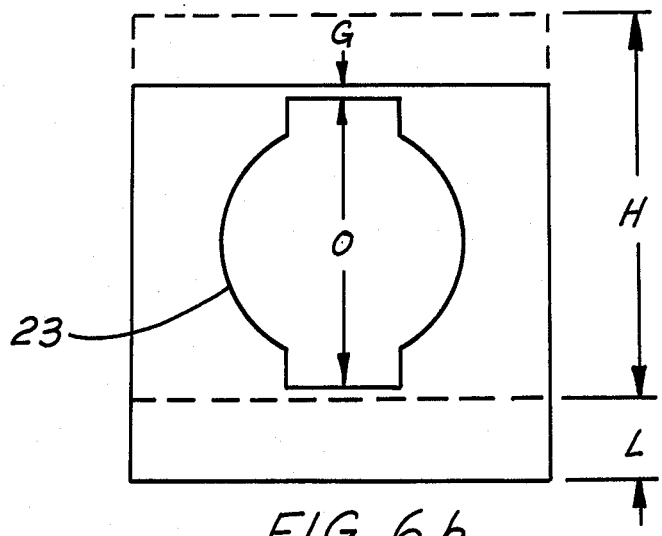
Figure 6C:
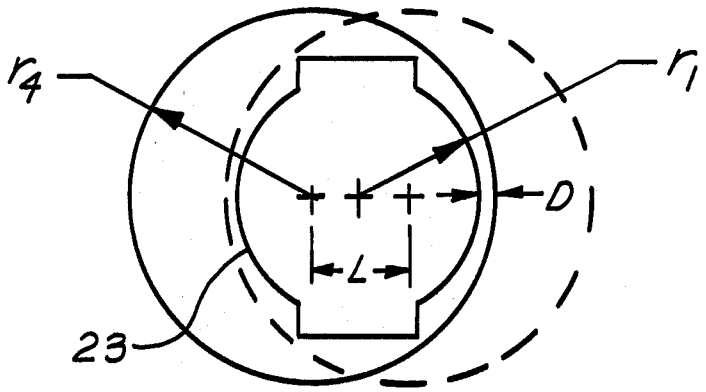

The specific construction details of these parts which enable the input/output port areas to be of a maximum possible size are now disclosed. In this type of fluid mechanism all fluid enters through the center of one side or end plate and is valved through the eccentric valve into the four variable volume chambers. The fluid then leaves these chambers, through the same eccentric valve, and flows out of the fluid mechanism through the center of the other side plate. Since the orbiting piston provides a fluid seal between the fluid entering or exiting the mechanism through the center side plates and the internal variable volume chambers, the wider the orbiting piston is, the larger the center port area can be made without being too large so as to allow unwanted fluid leaking or short circuiting into the internal chambers. The only means of providing adequate port area for high speed operation is to bell mouth or widen the orbiting piston. This feature is incorporated to the extent that during part of the piston's orbiting motion it must travel past or intersect the stationary chamber walls. This means that the housing end walls must be relieved or cut out such that the wide orbiting piston can travel unrestricted past the plane of the reciprocating chamber end members and into the circular cutouts provided in the stationary housing end members. FIG. 3 illustrates the wide bellmouthed orbiting piston 5 positioned closest to the stationary housing member 18, whereby the circular slot 25 is provided in the housing member to allow sufficient travel clearance for the orbiting piston. Referring to FIG. 6*a*, the radius $r_3$ of this clearance slot must always be greater than the outer radius $r_2$ of the orbiting piston's bell mouth by a factor of the clearance space C between the orbiting piston 5 and end of housing member 18 plus one half of the maximum stroke L of the mechanism. The maximum size which the side plate ports 23 can have is dependent on the following construction restrictions:

1. The circular cutout in the housing end members must be as large as possible with its maximum vertical length 0 in FIG. 6*b* being calculated as the distance H between the chamber member's upper and lower end seal pads (No. 4 typical) minus the maximum stroke L of the mechanism. This means the circular cutout can be as large as possible as long as it does not overlap the chamber member sealing path. 2. The orbiting piston can be constructed with a bellmouthed or bulbous end profile in which its width is equal to the overall diameter of the circular cutouts in the housing end pieces, plus two times the clearance space, and plus the maximum stroke L of the mechanism. In FIG. 6*c* the inner radius of the orbiting piston's bell mouth is $r_4$, the circular port portion has a radius $r_1$ and a clearance space D for a stroke L is provided when $r_4 = \frac{1}{2}$ L + $r_1$ + D. Similarly, for FIG. 6*a* to have an outer clearance C, $r_3 = \frac{1}{2}$ L $r_2$ + C and in FIG. 6*b* clearance gap G is provided when H − L = $2^G$ + 0.

3. The center side plate port area can be a maximum size which is defined as the total inside area swept by the end of the orbiting piston as it travels through a complete revolution minus the total area of this swept area which at any time is considered as part of the variable volume chambers.

An adjustment device is now disclosed which allows the fluid displacement to be changed while the mechanism is operating. The means by which the displaced volume per revolution is changed is by a device which changes the distance between the center line of the eccentric valve and the center line of the output shaft. In referring to FIG. 4 notice the output shaft 10 is slidably connected to the eccentric valve 8 inside the angled hole bushing 9. The method of changing the center line distance between the eccentric valve 8 and output shaft 10 is accomplished by providing a means to move the output shaft 10 longitudinally inside the eccentric bushing 9. Since the output shaft 10 contains an angled sleeve 11, and since the bushing 9 inside the eccentric is also angled in the same direction and with the same angle, any back and forth movement of the output shaft 10 will produce a radial displacement of the eccentric relative to the output shaft. This adjustment directly changes the center distance between the output shaft and eccentric. Further means is provided to keep the sleeve 11 from turning inside the bushing 9 by the pin 12. This pin does not restrict the back and forth movement of the output shaft 10 inside the bushing 9 during stroke adjustment. Further means is provided to impart a push/pull motion to the output shaft by an externally located adjustment knob device. The knob 16 is connected to the output shaft by a low friction coupling such as a ball bearing 13. The functon of the adjustment knob is to turn a threaded shaft 15 which in turn pushes or pulls on the coupling 14 to accomplish the back and forth adjustment feature required to change the stroke of the mechanism and in turn the displaced volume of an operating unit. A sufficiently long pinion gear 17 is provided to allow continuous engagement with another gear or coupling for power or instrument take off.

In summary, the orbiting piston fluid mechanism of the present invention is seen to structurally include the stationary mechanism housing 18 with the axially extending power transfer shaft 10 being supported in the housing opposed end plates 19 and 20 for rotation about the axis of that shaft with at least a part and in the disclosed embodiment all, of the shaft being selectively axially movable. An axially extending eccentric member 8 of generally cylindrical configuration is coupled to the shaft 10 for rotation with that shaft and the eccentric member axis is displaced from and extends generally parallel to the shaft axis. The chamber means 1 and 2 is confined within the housing interior for reciprocating motion in a direction generally perpendicular to the shaft axis and the piston 5 is supported on and rotatable relative to the eccentric member 8 while being confined within and reciprocable within and relative to the chamber means 1 and 2 in a direction generally perpendicular to the direction of chamber means reciprocation within and relative to the housing. With the coupling member 14 gripping the exterior portion of ball bearing 13, rotation of the knob 16 and its corresponding threaded engagement 15 with the housing end portion 20 causes axial movement of the shaft 10 and the tapered member 11 which is attached thereto relative to the tapered member 9 thus changing the distance between the shaft axis and the eccentric member axis. Pin 12 fastens the members 9 and 8 together and further functions to limit the axial movement of the shaft 10. Thus, axial movement of the shaft varies the distance between the eccentric member axis and the shaft axis to thereby also vary simultaneously the extent of reciprocating motion of the chamber means within the housing and the extent of reciprocating motion of the piston within the chamber means.

The output shaft and eccentric valve are configured such taht any axial movement of the shaft through the eccentric bushing 9 will produce a change in the distance between the parallel centers of the respective shaft and eccentric axes. This feature is accomplished simply by providing an angled segment 11 on the output shaft which is in sliding contact with a hole in the receptacle 9, which symetrically surrounds the angles shaft segment 11, and which hole is also angled in the same direction as the angled shaft segment. As the shaft is pushed through the eccentric with the center distance between the shaft and eccentric remaining parallel, but not constant, the angled shaft segment slips inside the eccentric angled hole towards the center of the eccentric when the shaft is in one direction and away from the eccentric center when the shaft is moved in the opposite direction. Thus, this angled interconnection between the two parts provide a change in the angled distance between these two ports when axial movement is provided. A pin is fixed in the eccentric or tapered member 9 but engages the angled shaft segment 11 and shaft 10, through a slot in that segment. The pin functions to allow the relative axial movement to accomplish the center distance change while keeping these ports from rotating relative to each other.

Considering FIGS. *5a–5d* it will be noted that the housing interior 27 and the chamber means 1 and 2 define one pair of diametrically opposed variable volume chambers 29 and 31 while the chamber means 1 and 2 in conjunction with the piston 5 define another pair of diametrically opposed variable volume chambers 33 and 35. It will be noted that in the 90° of rotation of the shaft 10 in going from each representation to the next, one chamber of each pair will be expanding while one chamber of each pair is contracting during all times of shaft rotation.

In order to prevent leakage, for example, between a contracting chamber and an expanding chamber, a number of strip seals such as 4 are employed and for example the four illustrated axially extending slots in the chamber means of FIG. 2 would each contain such a strip seal. Similarly, the eight axially extending slots in the piston illustrated in FIG. 3 would contain such a strip seal. In addition, a pair of spring loaded seals such as 3 function to seal the joints between the individual chamber portions 1 and 2 and provide a repulsion force between those individual chamber portions in a direction generally perpendicular to that of the chamber means reciprocation within the housing. These spring loaded seals such as 3 tend to urge the chamber portions 1 and 2 and their respective strip seals into sealing engagement with the housing interior. Sealing engagement between the housing end plate and the orbiting piston 5 and chamber means 1 and 2 are also provided where those respective moving parts engage the end plate.

In FIG. 2 it was noted earlier that the chamber means comprises separate individual portions 1 and 2 and these portions are confined to form a chamber for the piston 5 solely by the housing interior in the direction of piston reciprocation relative to the chamber means while those portions 1 and 2 are held apart to form the chamber for the piston means solely by the piston itself in the direction of chamber means reciprocation relative to the housing. The housing includes within its end plates 19 and 20 respective fluid passing ports such as 23 and those ports encompass substantially all areas of the inside surface of the respective end plates except for those areas in which short circuiting of the fluid past the sealing engagement of the respective end plate with the corresponding chamber means and piston would occur and except those areas contributing effective sealing between the respective end plate and chamber means and piston means to thereby maximize the port size. To further maximize that port size the opposed ends of the piston 5 are flared near the respective end plates outwardly in the direction of reciprocation of the piston relative to the chamber means and the chamber means itself is relieved in areas such as 37 while the housing is relieved, for example, in the area 25 to provide clearance between the piston and housing.

Figure 5A:
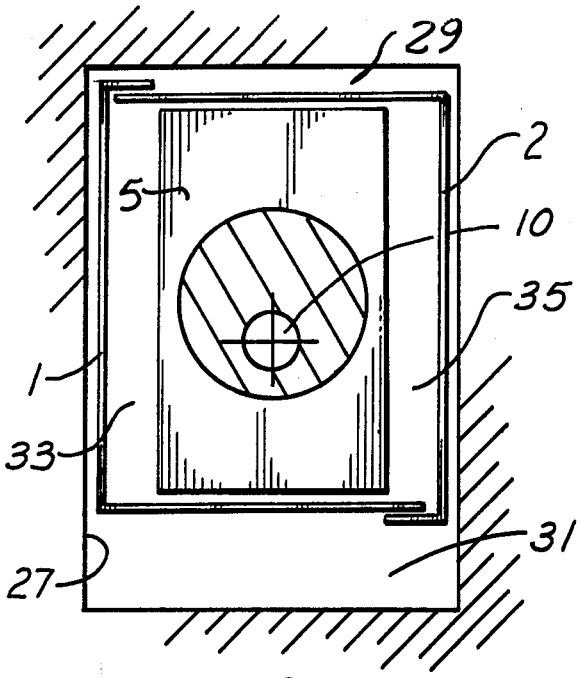
FIGS. 5*a*–5*d* represent an operational sequence of the fluid mechanism.
Figure 5B:
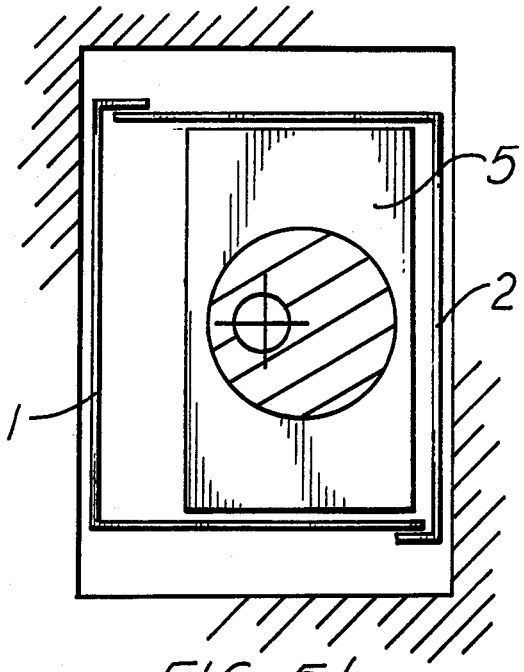
Figure 5C:
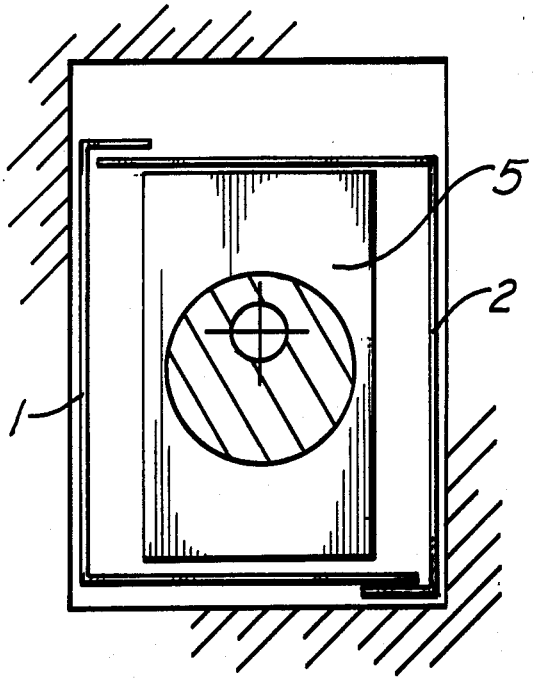
Figure 5D:
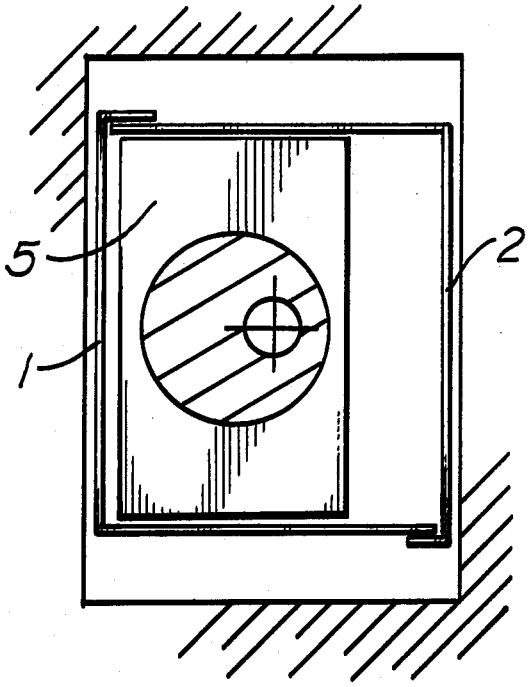

Fluid flow through the mechanism which occurs in unison with rotation of the shaft 10 may be rather easily traced by following the arrows in FIGS. 1, 2, 3, 4*a*, and 4*b*. At a time between that depicted in FIG. 5*a* and that depicted in FIG. 5*b*, the upper chamber 29 as viewed in the several views is expanding. At this time, fluid is flowing into inlet 39 in end plate 20 and progressing axially through the inlet port in that plate and into the eccentric member 8. The surface 41 of FIG. 4*a* and 4*b* diverts that axially flowing fluid from the inlet port and ejects it upwardly in a direction radially to the axes of the eccentric and shaft and through the top of piston 5, as well as the aperture 43 in the chamber member into chamber 29. During the same time interval chamber 31, the lower chamber as viewed in the several figures, is collapsing to expel fluid upwardly through aperture 45 in the chamber means 1 and 2 through aperture 47 in the piston and radially inwardly through an opening 49 in the eccentric member to be diverted by the opposite side of surface 41 into an axial flow to the outlet port 23 which communicates with outlet 51 in end plate 19. Opposed chambers 33 and 35 will be alternately expanding and collapsing and similar fluid flow may be traced for those chambers.

Thus while the present invention has been described with respect to a specific preferred embodiment, numerous modifications will suggest themselves to those of ordinary skill in the art and accordingly the scope of the present invention is to be measured by that only of the appended claims.

What is claimed is:

1. An orbiting piston fluid mechanism comprising:

a stationary mechanism housing;

an axially extending power transfer shaft supported in the housing for rotation about the shaft axis, at least part of the shaft being selectively axially movable;

an axially extending eccentric member coupled to the shaft for rotation therewith, the eccentric member axis displaced from and extending generally parallel to the shaft axis;

chamber means confined within the housing interior for reciprocating motion in a direction generally perpendicular to the shaft axis;

piston means supported on and rotatable relative to the eccentric member, and confined within and reciprocable within and relative to the chamber means in a direction generally perpendicular to the direction of chamber means reciprocation within and relative to the housing; and means including an inclined member movable axially in response to axial movement of the axially movable part of the power transfer shaft for selectively varying the distance between the eccentric member axis and the shaft axis to thereby also vary simultaneously the extent of reciprocating motion of the chamber means within the housing and the extent of reciprocating motion of the piston means within the chamber means.

2. The mechanism of claim 1 wherein the housing interior and chamber means define one pair of diametrically opposed variable volume chambers and the chamber means and piston means define another pair of diametrically opposed variable volume chambers, one chamber of each pair expanding and one chamber of each pair contracting at all times during shaft rotation.

3. The mechanism of claim 2 further comprising sealing means for preventing fluid leakage between a contracting chamber and an expanding chamber.

4. An orbiting piston fluid mechanism comprising:

a stationary mechanism housing;

an axially extending power transfer shaft supported in the housing for rotation about the shaft axis;

an axially extending eccentric member coupled to the shaft for rotation therewith, the eccentric member axis displaced from and extending generally parallel to the shaft axis;

chamber means confined within the housing interior for reciprocating motion in a direction generally perpendicular to the shaft axis;

piston means supported on and rotatable relative to the eccentric member, and confined within and reciprocable within and relative to the chamber means in a direction generally perpendicular to the direction of chamber means reciprocation within and relative to the housing;

the chamber means comprising separate individual portions confined to form a chamber for the piston means solely by the housing interior in the direction of piston reciprocation relative to the chamber means, and held apart to form the chamber for the piston means solely by the piston in the direction of chamber means reciprocation relative to the housing.

5. The mechanism of claim 4 including spring loaded sealing means for simultaneously sealing the joints between the individual chamber portions and providing a repulsion force between individual chamber portions in a direction generally perpendicular to that of chamber means reciprocation within the housing to urge the chamber portions into sealing engagement with the housing interior.

6. An orbiting piston fluid mechanism comprising:

a stationary mechanism housing;

an axially extending power transfer shaft supported in the housing for rotation about the shaft axis;

an axially extending eccentric member coupled to the shaft for rotation therewith, the eccentric member axis displaced from the shaft axis by a distance constituting the crank radius and extending generally parallel to the shaft axis;

chamber means confined within the housing interior for reciprocating motion in a direction generally perpendicular to the shaft axis, the chamber means sealingly engaging opposed housing side walls which opposed side walls are separated by a lateral distance *d;* piston means supported on and rotatable relative to the eccentric member, and confined within and reciprocable within and relative to the chamber means in a direction generally perpendicular to the direction of chamber means reciprocation within and relative to the housing, the piston being bell-mouthed near its opposite ends and a maximum lateral width $2R_2$ in its direction of reciprocation;

the housing including opposed end plates rotatably supporting the shaft with interior generally flat parallel surfaces, each end plate surface having at least one fluid passing port, the housing side walls being relieved near the opposed end plates to accommodate to bell-mouthed portions of the piston with the sum of the crank radius and maximum bell-mouthed piston width $2R_2$ exceeding the distance d, the chamber means and piston means sealingly engaging the opposed end plate flat surfaces with the fluid passing ports encompassing substantially all areas of the inside surface of the respective end plates except those areas in which short circuiting of the fluid past the sealing engagement of the respective end plate with the chamber means and piston means would occur and except those areas contributing effective sealing between the respective end plate and chamber means and piston means to thereby maximize port size.

7. The mechanism of claim 6 wherein the port in one end plate is a fluid inlet port while the port in the other end plate is a fluid outlet port, the eccentric member including inlet diverter means for receiving axially flowing fluid from the inlet port and ejecting that fluid in a radial direction.

8. The mechanism of claim 7 wherein the eccentric member further includes outlet diverter means for receiving fluid flowing radially inwardly and supplying that fluid axially to the outlet port.

9. The mechanism of claim 8 wherein the housing interior and chamber means define one pair of diametrically opposed variable volume chambers, and the chamber means and piston means form another pair of variable volume diametrically opposed chambers and wherein both said diverter means are operative continuously, one to supply inlet fluid to at least one expanding chamber while the other receives fluid from at least one collapsing chamber diametrically opposed to the expanding chamber .

10. An orbiting piston fluid mechanism comprising:

a stationary mechanism housing;

an axially extending power transfer shaft supported in the housing for rotation about the shaft axis;

an axially extending eccentric member coupled to the shaft for rotation therewith, the eccentric member axis displaced from the shaft axis by a distance constituting the crank radius and extending generally parallel to the shaft axis;

chamber means confined within the housing interior for reciprocating motion in a direction generally perpendicular to the shaft axis;

piston means supported on and rotatable relative to the eccentric member, and confined within and reciprocable within and relative to the chamber means in a direction generally perpendicular to the direction of chamber means reciprocation within and relative to the housing;

the housing including opposed end plates rotatably supporting the shaft with interior generally flat parallel surfaces, each end plate surface having at least one fluid passing port, the chamber means and piston means sealingly engaging the opposed end plate flat surfaces with the chamber means sealingly engaging an end plate along distances *d* perpendicular to its direction of reciprocation, the opposed ends of the piston means near the respective end plates being flared outwardly to a total lateral distance greater than the difference between the distance *d* and the crank radius in the direction of reciprocation of the piston means relative to the chamber means, and the chamber means and the housing interior being correspondingly relieved to provide clearance between the piston means and housing to thereby maximize the potential port area in the end plate surface.

* * * * *